United States Patent [19]

Murphy et al.

[11] Patent Number: 4,795,007

[45] Date of Patent: Jan. 3, 1989

[54] BRAKE ROD PROTECTOR

[75] Inventors: Richard F. Murphy, Batavia; Michael K. Burke, Wheaton, both of Ill.

[73] Assignee: Zeftek, Inc., Batavia, Ill.

[21] Appl. No.: 77,695

[22] Filed: Jul. 24, 1987

[51] Int. Cl.[4] ..... F16D 15/07

[52] U.S. Cl. ..... 188/207; 188/214; 188/219.1; 384/42

[58] Field of Search ..... 188/205 R, 207, 210, 188/214, 219.1, 212, 209; 384/42, 26, 7; 248/58, 65

[56] References Cited

U.S. PATENT DOCUMENTS

| | | | |
|---|---|---|---|
| 2,835,539 | 5/1958 | Conrad | 384/42 |
| 4,079,818 | 3/1978 | Chierici . | |
| 4,188,888 | 2/1980 | Cooper et al. . | |
| 4,237,792 | 12/1980 | Somers . | |
| 4,237,793 | 12/1980 | Holden . | |
| 4,238,039 | 12/1980 | Cooper et al. . | |
| 4,239,007 | 12/1980 | Kleykamp et al. . | |
| 4,249,665 | 2/1981 | Kleykamp . | |
| 4,261,472 | 4/1981 | Moore et al. . | |
| 4,264,015 | 4/1981 | Mathieu . | |
| 4,289,077 | 9/1981 | Kleykamp et al. . | |
| 4,452,345 | 6/1984 | Mathieu . | |
| 4,616,884 | 10/1986 | Baker | 384/7 |

FOREIGN PATENT DOCUMENTS

| | | | |
|---|---|---|---|
| 0472784 | 4/1951 | Canada | 188/207 |
| 2025169 | 12/1971 | Fed. Rep. of Germany | 384/42 |
| 2342863 | 2/1974 | Fed. Rep. of Germany | 384/7 |

*Primary Examiner*—Andres Kashnikow
*Assistant Examiner*—Richard Potosnak
*Attorney, Agent, or Firm*—Lloyd L. Zickert

[57] ABSTRACT

A brake rod protector for a brake rod in a braking system of a railway vehicle to repair a worn brake rod or to provide protection against wear along an area where wear normally occurs. The protector includes a metal base plate shaped to conform with the brake rod and be attached thereto by welding or the like and a body of plastic material bonded to the outer surface of the base plate and to be slidably engageable with a member of the braking system or the railway vehicle.

12 Claims, 2 Drawing Sheets

BRAKE ROD PROTECTOR

This invention relates in general to a brake rod protector for attachment to a brake rod of a braking system in a railway car, and more particularly to an improved brake rod protector capable of being easily attached to a brake rod and for providing a plastic body of self-lubricating material for sliding engagement with a member normally slidably engaged by the brake rod.

BACKGROUND OF THE INVENTION

It has been well known to provide plastic wear members for railway vehicles. For example, U.S. Pat. Nos. 4,188,888; 4,237,792 and 4,289,077 show wear members in the form of liners for center bearings of trucks. Wear members of plastic have also been widely used at the sliding surfaces of coupler members, as disclosed in U.S. Pat. Nos. 4,238,039; 4,249,665; 4,261,472, and 4,264,015. Plastic wear members have further been used for pedestals of a railway truck, as disclosed in U.S. Pat. Nos. 4,237,793 and 4,239,007.

Heretofore, it has also been known to provide wear members for brake rods. One well known wear member is in the form of a plastic sleeve fittable over the brake rod and held in place by a metal retainer, as disclosed in U.S. Pat. No. 4,079,818. The entire wear member is of plastic material and merely fits over the brake rod so as to define a plastic surface for engagement with a U-shaped hanger and for the primary purpose of protecting the brake rod and support hanger from wear in the area where the rod is supported. This wear member is not readily usable for repairing a worn brake rod.

Another wear member for a brake rod is disclosed in U.S. Pat. No. 4,452,345, which is in the form of a plate of plastic material that is attached to a U-shaped hanger to provide a plastic surface on which the brake rod is slidably supported. This wear device likewise cannot be used to repair a worn brake rod.

These wear members have been developed following the availability of suitable plastic resins and particularly certain polyethylenes, such as a linear high-density polyethylene which is usually referred to as an ultra-high molecular weight polyethylene. As disclosed in some of the above patents, these plastic materials have been bonded to metal supporting members which are then mounted on supporting parts of a railway vehicle.

SUMMARY OF THE INVENTION

The present invention is directed to an improved wear member for a vehicle brake rod, and it is appreciated that brake rods in railway cars braking systems are quite often in sliding engagement with other members during movement of the railway vehicle or during operation of the braking system. Normally, the other members engaging a brake rod are also metal like the brake rod. Accordingly, the brake rod protector of the present invention prevents the metal-to-metal contact between brake rods and an axle, hanger or other member.

The brake rod protector of the present invention includes a metal base plate such as of steel or other suitable metal and shaped to fit a brake rod and a body of plastic material bonded to the base plate which then defines a plastic-to-metal contact between a brake rod and an axle or a hanger of a vehicle or other part of a vehicle. Because the brake rod protector of the present invention includes a metal base plate with a plastic body bonded thereto, it can serve to repair worn brake rods and eliminate the necessity to replace those brake rods even if the brake rod is worn up to fifty percent. It also can be used to protect unworn brake rods and, in any event, will outlast many standard brake rods, Use of the protector also substantially eliminates wear to parts contacted by the brake rod.

The metal base of the brake rod protector is generally semicircular or U-shaped in cross section whereby the concave side would fit against the brake rod that is usually cylindrical in cross section. The base plate cross section may be otherwise shaped depending on the shape of the rod so that they suitably mate together. It would be sized to fit the largest diameter brake rod but could equally well be used on a smaller diameter brake rod. Thus, the wear protector would be applicable to various diameter rods, thereby reducing inventories and the heretofore known need to have one size for each size brake rod. The plastic body bonded to the plate is formed to have a flat surface for engaging the metal part of the vehicle frame, thereby eliminating point-to-point contact produced by a curvate surface and ultimately lowering the psi loading. The flat surface on the plastic body additionally distributes the wear of the plastic body which greatly extends its life.

The brake rod protector or wear protector of the invention not only extends the life of brake rods but also extends the life of hangers, axles or other members in contact therewith that would require maintenance or replacement when excessively worn. Use of the brake rod protector of the invention generally eliminates the need to repair other contacting parts. When the protector of the invention with its steel base plate is mounted on a worn brake rod, it further serves to stiffen and strengthen the rod and eliminates costly rod replacement. The repaired rod would be as strong as, if not stronger than, in its original condition.

Further, the wear protector of the present invention can be mounted on a brake rod and therefore in a brake system without requiring disassembly of the brake system or any of the car parts. This eliminates intensive labor costs and time which minimizes downtime of the car.

Thus, the present invention can be more easily used for repairing worn brake rods to lengthen the life of the brake rod and to decrease the amount of time needed to correct a worn brake rod probelm by eliminating the need to replace the brake rod.

It is therefore an object of the present invention to provide a new and improved brake rod protector for use in repairing worn brake rods of vehicles or to eliminate wear of a brake rod in an area of normal wear.

A further object of the present invention is in the provision of a brake rod protector including a metal base plate shaped to conform to the brake rod and being weldable thereto and having a plastic body for engagement with a metal part of the braking system or the car on which the braking system is mounted, whereby the life of a brake rod is materially enhanced.

A further object of the present invention is to provide an improved brake rod protector having a body of plastic material bonded to a metal base plate that is attachable by welding or otherwise to a brake rod and wherein the plastic body is shaped to provide a substantial bearing surface for distributing the load over a broader surface and to eliminate point-to-point contact that tends to shorten the life of parts.

Another object of the present invention is to provide an improved brake rod protector having a plastic material bonded to a metal base plate that is attachable to a brake rod and wherein the plastic body is configured to provide a flat surface for engagement with the contacting part of the vehicle body and which results in distributing the wear of the plastic body and lowers the psi loading between the brake rod and vehicle part.

A still further object of the invention is in the provision of a new and improved brake rod protector that may be easily mounted on a brake rod and which does not require disassembly of the brake system or car parts to thereby minimize labor cost and down time.

A still further object of the invention is in the provision of an improved brake rod protector which is configured to fit brake rods of various diameters, thereby reducing the need to have one size protector for each size of brake rod, thereby reducing inventory of parts.

A still further object of the present invention is to provide a new and improved brake rod protector for repairing worn brake rods and which also stiffens and strengthens a worn brake rod when welded thereto and eliminates costly replacement and which eliminates further brake rod wear at areas normally contacting metal. In this situation, it is extremely cost effective.

Another object of the present invention is to provide a new and improved brake rod protector for repairing worn brake rods or for application to new brake rods which is configured to fit brake rods of various sizes and which not only materially extends the life of the brake rods but also hangers, axles or other parts normally contacted by the brake rod, and also usually eliminates the need to repair contacting parts.

Other objects, features and advantages of the invention will be apparent from the following detailed disclosure, taken in conjunction with the accompanying sheets of drawings, wherein like reference numerals refer to like parts.

DESCRIPTION OF THE INVENTION

The brake rod protector of the invention is primarily usable for preventing or correcting wear of a brake rod in a braking system of a railway vehicle, although it should be appreciated that it could be used for other systems having slidably movable rods engaging metal parts. Thus, the protector may not only be used to protect against wear of brake rods but also to repair worn brake rods to extend the life of such brake rods.

Figure 1:
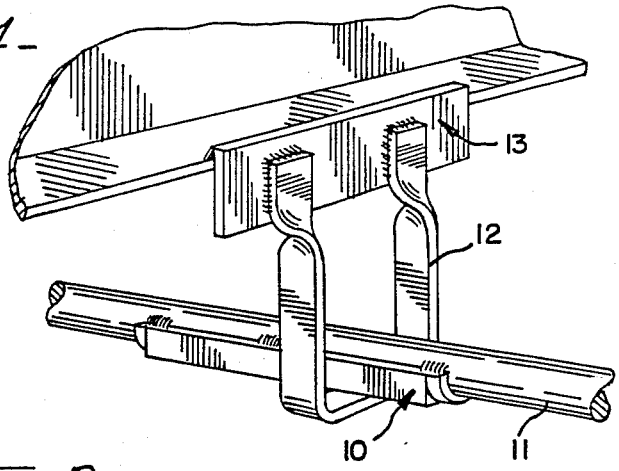
FIG. 1 is a fragmentary perspective view of a part of a railway vehicle having a U-shaped supporting hanger for a brake rod and illustrating the brake rod protector of the present invention mounted on a brake rod in the area where the brake rod normally engages the hanger.
Figure 2:
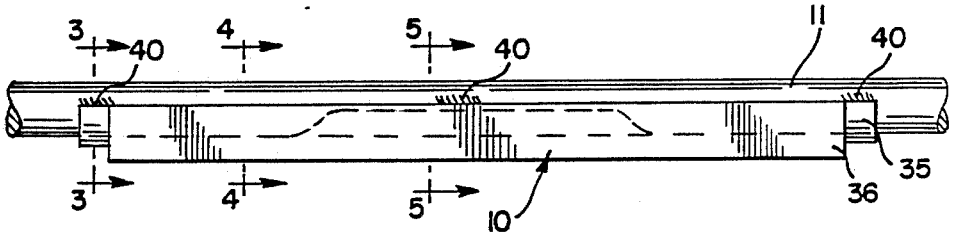
FIG. 2 is a longitudinal elevational view of a brake rod having a worn area and also the brake rod protector of the present invention mounted over the worn area.
Figure 3:
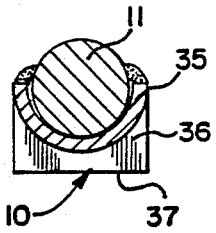
FIG. 3 is a vertical sectional view taken substantially along line 3—3 of FIG. 2.
Figure 4:
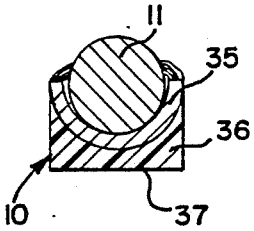
FIG. 4 is a vertical sectional view taken substantially along line 4—4 of FIG. 2.
Figure 5:
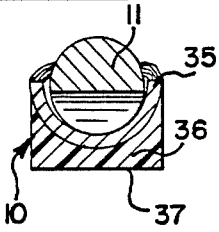
FIG. 5 is a substantially vertical sectional view taken substantially along line 5—5 of FIG. 2.
Figure 6:
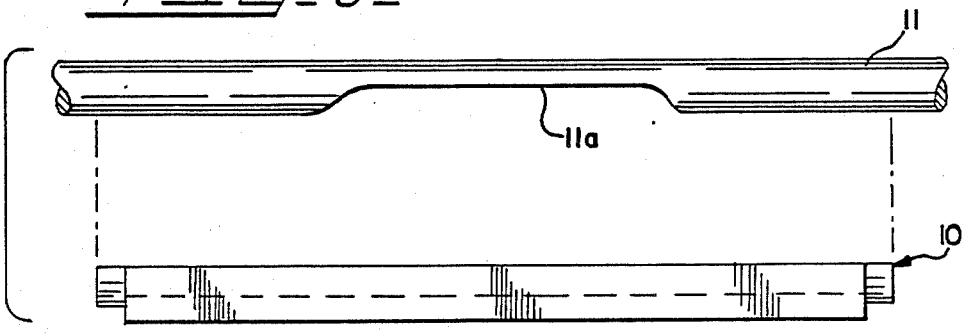
FIG. 6 is an exploded view of the brake rod and brake rod protector shown in FIG. 2 to more clearly illustrate the worn area along the brake rod.
Figure 7:
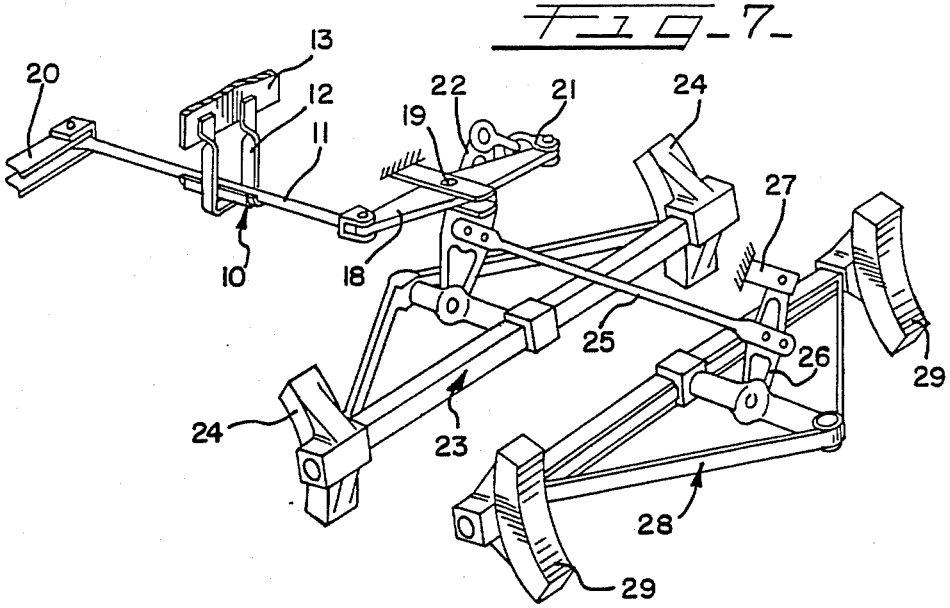
FIG. 7 is a perspective view of a braking system for a railway vehicle to illustrate more particularly one location for using the brake rod protector of the present invention along a brake rod.

Referring now to the drawings, and particularly to FIGS. 1 and 7, one use of a brake rod protector of the present inention is for use along brake rods that are supported by hangers from the railway car frame. The brake rod protector of the invention, generally designated by the numeral 10, is shown in mounting relation on a brake rod 11 supported by a U-shaped hanger 12 that is in turn suitably secured to a frame member 13 of a railway car. The brake rod 11 extends generally in a horizontal direction and in the system illustrated along the longitudinal axis of the railway car having the braking system. The brake rod 11 normally would be primarily supported intermediate its ends by the U-shaped hanger 12 and inasmuch as both the hanger and rod are made ofmetal, there would be metal-to-metal contact. During travel of the car, the brake rod not being in a rigid relationto the hanger would tend to move relative to the hanger due to vibration and oscillation of the car, and also during operation of the braking system, the rod would be in sliding engagement with the hanger.

A braking system of one kind is illustrated in FIG. 7. One end of the brake rod 11 is connected to one end of a horizontally extending lever 18 that is pivoted intermediate its ends at 19 to a support fixed to the car frame. The other end of the brake rod 11 is pivotally connected to an actuating bar 20 where a force is first applied for purposes of moving the brake rod to in turn cause swinging of the lever 18. The end of the lever 18 opposite its connection to the brake rod is pivotally connected to a clevis 21 on one end of a live lever 22. The other end of the live lever 22 is pivotallyconnected to the brake beam 23 having brake shoes 24, while a connecting rod 25 connects intermediate the ends of live lever 22 with a dead lever 26. The dead lever 26 is pivotally connected at one end to a fixed frame member 27 and at the other end to a second brake beam 28 having brake shoes 29. Thus, actuation of the brake rod 11 effects actuation of both brake beams 23 and 28.

The brake rod protector 10, as seen particularly in FIGS. 1 through 6, includes a metal base plate 35, and a body of plastic material 36. The base plate 35 is substantially semi-circular in cross section and sized to fit brake rods of various diameters. By having a radius slightly larger than the largest brake rod, it can be used on the largest brake rod as well as one somewhat smaller in cross section. While the base plate is substantially semi-circular, and this would be the usual form as brake rods are normally circular in cross section, it can be appreciated that if a brake rod is of a different cross-sectional configuration, the base plate of the brake rod protector of the invention may conform to that shape, so that it could be easily and effectively attached to the rod. While the base plate would normally be of a suitable steel, it could be made of othermetals if desired.

The plastic body 36 is bonded to the base plate by any suitable method. Normally, the plastic bodyis molded directly to the base plate and as illustrated is molded to the convex side of the base plate. In cross section the plastic body is somewhat rectangular in shape and provides an elongated flat surface 37 which constitutes the bearing surface of the wear protector as it engages a metal part such as the hanger 12. Accordingly, the surface is elongated and provides a broad bearing surface and effectively converts a line contact arrangement between the brake rod and the hanger to a broad surface contact between the rod and hanger, thereby better distributing hte load of the rod.

While any suitable plastic material may be used, it will be appreciated that the plastic material preferably be a linear high-density polyethylene which is usually referred to as an ultra-high molecular weight polyethylene. One such acceptable polymer material is defined as "1900 UMHW polymer" and available from Himont U.S.A. It is also preferably that the plastic be black in color, as black has the highest resistance to ultra-violet and also because balck has the most suitable heat coefficient during holding which requires heat and pressure. This plastic resin is also self-lubricating so as to minimize wear on any surface it engages.

It is a nominal rule that where a brake rod is worn through fifty percent or more, it must be replaced. This requires a certain replacement time period and is also costly. The brake rod protector of the present invention eliminates the need for replacing such a brake rod with a new one in that the protector can be quickly and easily welded onto the brake rod at the worn area, as shown in FIGS. 2 to 6, to thereby repair the brake rod and without need of removal from the braking system. It is only necessary to position the brake rod protector 10 over the worn area 11*a* of the brake rod 11, as illustrated particularly in FIGS. 2 and 6, and then tack- or stitch-weld the protector to the brake rod. Welding can be done by tack- or stitch-welding, as shown at 40 in FIG. 2, which is welding along the side edges of the base plate so it can be welded directly to the brake rod. Alternately, the brake rod protector may have welds placed at the opposite ends of the base plate with the brake rod, or welds could be made along the side edges and the ends. Inasmuch as the brake rod protector includes a metal base, it can be appreciated that when it is welded into place on a brake rod, it will strengthen the brake rod in the area of wear.

Optionally, the plastic body may be molded so as to provide a free area along the upper edges of the metal base plate, while still providing a broad flat surface for bearing against a metal part. Further, while it is illustrated that the brake rod protector is attached to the brake rod by welding, it may be appreciated that it can be otherwise suitable attached, such as by a hose clamp at the ends where the metal base plate 35 extends beyond the plastic material. Once the brake rod protector is mounted to the brake rod, it effectively renews the brake rod to a form equal to or better than when it was new. However, it should be further appreciated that the brake rod protector may be used on new brake rods that have no wear and which quite obviously will materially extend the life of the brake rod.

Figure 8:
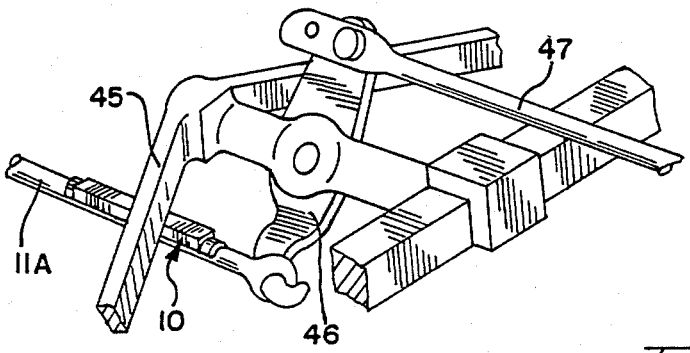
FIG. 8 is a perspective view of another type of braking system for a railway vehicle and illustrating another location for using a brake rod protector on a brake rod.

The portion of the braking system shown in FIG. 8 illustrates the brake rod protector 10 of the invention mounted on the top surface of a brake rod 11A inasmuch as the rod 11A is disposed beneath a frame member 45 and where the wear of the brake rod 11A is occurs on the top surface of the brake rod. Here the brake rod 11A is connected to one end of a lever 46 pivoted intermediate its ends and having the other end pivotally connected to a further force transmission rod 47.

Figure 9:
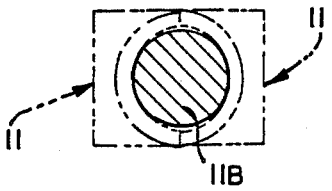
FIG. 9 is a vertical sectional view taken through a brake rod and illustrating in phantom the potential use of a brake rod protector according to the invention at opposite sides of the brake rod.

FIG. 9 illustrates a brake rod 11B and in phantom where the brake rod protector of the invention may be mounted on either side of the brake rod. Actually, it could be mounted at any part of the brake rod wherever there would be metal-to-metal engagement of another part and for the purpose of repairing a worn area or for inhibiting wear along a brake rod to enhance its life. It should further be appreciated that while the brake rod protector is illustrated as being mounted on horizontally extending brake rods, it could be mounted on vertically extending rods or rods that are inclined to the horizontal.

It will be understood that modifications and variatins may be effected without departing from the scope of the novel concepts of the present invention, but it is understood that this application is to be limited only by the scope of the appended claims.

The invention is hereby claimed as follows:

1. In a vehicle having a movable rod engaging a part of the vehicle where the rod is subjeted to wear, a wear member attachable to the rod to eliminate wear between the rod and part, said wear member comprising an elongated channel-shaped metal base plate and a body of plastic material bonded to one side of the plate, the length of said member being at least equal to the length of maximum movement expected between the rod and said vehicle port, means directly attaching the side of the base plate opposite the side to which the plastic material is bonded to said rod, and said plastic body having a bearing surface defining a broad support for engaging the vehicle port and which conforms to the geometrical shape of the engaging surface of the vehicle.

2. The protector of claim 1, wherein the plastic body is of linear high density polyethylene.

3. The protector of claim 1, wherein the plastic body is of ultra-high molecular weight polyethylene.

4. The protector of claim 3 wherein the polyethylene is black.

5. In a railroad car with a braking system having a movable brake rod supported intermediate its ends by a car mounted hanger, a wear member attachable to the brake rod to eliminate wear between the brake rod and the hanger, said wear member comprising an elongated channel-shaped metal base plate and a body of plastic material bonded to one side of the plate, the length of said member being at least equal to the length of maximum movement expected between the rod and hanger, means directly attaching the side of the base plate opposite the side to which the plastic material is bonded to said rod, and said plastic body having a bearing surface defining a broad support for engaging the hanger and which conforms to the geometrical shape of the engaging surface of the hanger.

6. The wear member of claim 5, wherein the base plate is substantially semi-circular in cross section to substantially conform to the crosssectional shape of the brake rod and the plastic body being bonded to the convex side of the plate.

7. The wear member of claim 6, wherein the bearing surface is opposite to the surface of the plate engaging the rod.

8. The wear member of claim 7, wherein the flat bearing surface is opposite to the surface of the plate engaging the rod.

9. The wear member of claim 8, wherein the plastic body is of ultra-high molecular weight polyethylene.

10. The wear member of claim 9, wherein the polyethylene is black.

11. A wear protector for a generally circular in cross section movable metal brake rod in a braking system for a railway vehicle to repair a worn area of a brake rod cause by sliding engagement between the brake rod and a member of the system or the vehicle and to eliminate wear along the brake rod in the area of normal sliding engagement with said member, said wear protector comprising an elongated generally semi-circular base plate and a body of plastic material bonded to the convex side of said base plate, said body of plastic material having an elongated bearing surface for slidable engagement with said member of a length at least equal to the maximum sliding movement expected of said rod, and the concave side of said wear protector being directly attachable be welding or other suitable means to said rod along the side thereof engaging said member.

12. The wear protector of claim 11, wherein the bearing surface is substantially flat.

* * * * *

UNITED STATES PATENT AND TRADEMARK OFFICE

CERTIFICATE OF CORRECTION

PATENT NO. : 4,795,007

DATED : January 3, 1989

INVENTOR(S) : RICHARD F. MURPHY and MICHAEL K. BURKE

It is certified that error appears in the above-identified patent and that said Letters Patent is hereby corrected as shown below:

Col. 2, line 46, change "probelm" to --problem--;
Col. 4, line 25, change "ofmetal" to --of metal--;
line 27, change "relationto" to --relation to--;
line 41, change "pivotallyconnected" to --pivotally connected--;
line 64, change "othermetals" to --other metals--;
line 66, change "bodyis" to --body is--;
Col. 5, line 9, change "hte" to --the--;
line 16, change "preferably" to --preferable--;
line 19, change "holding" to --molding--;
line 52, change "suitable" to --suitably--;
line 65, delete "is";
Col. 6, line 15, change "variatins" to --variations--;
line 22, change "subjeted" to --subjected--;
line 29, change "port" to --part--;
line 33, change "port" to --part--;
line 35, after "vehicle" insert --part--;
line 60, change "crosssectional" to --cross-sectional--;
lines 64-65, change "is opposite to the surface of the plate engaging the rod" to --of the plastic body is substantially flat--;
Col. 7, line 8, change "cause" to --caused--; and

UNITED STATES PATENT AND TRADEMARK OFFICE

CERTIFICATE OF CORRECTION

PATENT NO. : 4,795,007

DATED : January 3, 1989

INVENTOR(S) : Richard F. Murphy et al.

It is certified that error appears in the above-identified patent and that said Letters Patent is hereby corrected as shown below:

Column 8, line 7, change "be" to -- by --.

Signed and Sealed this

Twenty-third Day of May, 1989

*Attest:*

*Attesting Officer*

DONALD J. QUIGG

*Commissioner of Patents and Trademarks*